United States Patent [19]

Dobrusskin et al.

[11] Patent Number: 4,490,642

[45] Date of Patent: Dec. 25, 1984

[54] HIGH-PRESSURE SODIUM DISCHARGE LAMP

[75] Inventors: Alexander Dobrusskin, Taufkirchen; Georg Marsen, Ottobrunn, both of Fed. Rep. of Germany

[73] Assignee: Patent-Treuhand-Gesellschaft fur Elektrische Gluhlampen mbH, Munich, Fed. Rep. of Germany

[21] Appl. No.: 397,186

[22] Filed: Jul. 12, 1982

[30] Foreign Application Priority Data

Jul. 24, 1981 [DE] Fed. Rep. of Germany ..... 3129329

[51] Int. Cl.[3] ..... H01J 61/30; H01J 61/34; H01J 61/12; H01J 5/12

[52] U.S. Cl. ..... 313/25; 313/634; 313/637; 313/113

[58] Field of Search ..... 313/25, 573, 634, 635, 313/636, 637, 113, 44

[56] References Cited

U.S. PATENT DOCUMENTS 2,135,696 11/1938 Baumhauer et al. ..... 313/25
3,225,244 12/1965 Van Der Weijer et al. ... 313/573 X
3,248,590 4/1966 Schmidt ..... 313/184
4,150,317 4/1979 Laska et al. ..... 313/636 X
4,281,267 7/1981 Johnson ..... 313/635 X

*Primary Examiner*—David K. Moore
*Assistant Examiner*—K. Wieder
*Attorney, Agent, or Firm*—Frishauf, Holtz, Goodman & Woodward

[57] ABSTRACT

To improve the color rendition index $R_a$, and to lower the color temperature without decreasing the light yield and efficiency of the lamp, the discharge vessel (1, 12, 22) is surrounded by an envelope which comprises a first, or inner envelope element (4, 13, 21) and a second, or outer envelope element (5, 14, 20). The space between the first and second envelope elements, preferably, is evacuated, and the space between the first, inner envelope element and the discharge vessel may include an inert gas, such as nitrogen and/or a noble gas; if the inner envelope element and the discharge vessel are both made of sodium resistant materials, such as $Al_2O_3$, the space between the inner envelope element and the discharge vessel may also include sodium of such quantity as to balance the vapor pressure within the discharge vessel and said space outside of the discharge vessel. The lamp can be made double-ended (FIGS. 1, 2) or single-ended (FIG. 3).

19 Claims, 5 Drawing Figures

HIGH-PRESSURE SODIUM DISCHARGE LAMP

The present invention relates to a high-pressure sodium discharge lamp, and more particularly to such a discharge lamp whch has a fill which includes an amalgam of sodium and mercury, and a discharge vessel, with electrodes therein, which is made of material resistant to sodium, such as $Al_2O_3$.

BACKGROUND

Various types of sodium discharge lamps are known, see for example U.S. Pat. No. 3,248,590; German Pat. No. 1,957,978. Usually sodium high-pressure discharge lamps have a color rendition index $R_a$ of 20, a light yield of 120 lm/W and a color temperature of 2100° K (see, for example, IEE Proceedings-A, Vol. 127, No. 3 (1980), p. 162). It has been tried to increase the sodium vapor pressure by increasing the surrounding temperture, and increasing the electric loading, to obtain a higher color rendition index $R_a$ of 85, for example, see Kühl, Paper No. 3, Conf. Assoc. of Public Lighting Engineers, Scarborough (1973), pp. 2 and 3. The light yield is somewhat less, 92 lm/W, the color temperature 2400° K. Manufacture of such a lamp for commercial use has been difficult, since the resistance of the material of the vessel, usually $Al_2O_3$ decreases upon increased thermal wall loading, which decreases the lifetime of the lamp - see IEE Proceedings-A, Vol. 127, No. 3 (1980), p. 167. It is also known to increase the color rendition index by heating the ends of the discharge vessel by using heat reflectors, for example in the form of metal caps - see German Patent Disclosure Document DE-OS 29 28 067.

THE INVENTION

It is an object to improve sodium high-pressure discharge lamps so that the lamps have an increased color rendition index as well as a better color temperature.

Briefly, the sodium vapor pressure can be increased by surrounding the discharge vessel with an envelope system which has a first, or inner envelope element and a second, or outer envelope element. Preferably, the space between the two envelope elements is evacuated.

The discharge vessel as well as the respective envelopes of the sodium vapor discharge lamp can be separate structural elements or can be made as combined structural elements in various combinations. For example, the inner envelope and the vessel may be constructed to form a single structural unit.

The lamp can be made single-ended or double-ended, and if made double-ended, for example, the discharge vessel can be made tubular with electrodes located at the respective ends. The two envelope elements are then constructed to concentrically surround the discharge vessel with little spacing therefrom. Alternatively, a single-ended lamp can be constructed in which the discharge vessel is closed off at one side and the electrodes are passed through a press at that one end; spaced by a small distance therefrom, the discharge vessel is surrounded by the two envelope elements.

It is also possible to so construct the lamp that the discharge vessel is closely surrounded by the inner envelope element; the outer envelope element can be constructed as a reflector bulb, an ellipsoidal bulb, or as a single-ended tubular bulb.

A lamp in which the two envelope elements of the envelope as well as the discharge vessel consist of structurally separate units is preferably constructed by making the two outer envelope elements of quartz glass; the envelope element close to the discharge vessel preferably is coated with an infrared reflective layer and/or with heat reflective layers applied at the outside adjacent its ends. A typical heat reflector layer is made, for example, of zirconium dioxide. It is also possible to construct the outer envelope element of hard glass.

The outer envelope element, independently of the material of which it is made, may have an infrared reflective layer applied thereto. In some cases it is desirable to make the inner envelope element, that is, the one close to the discharge vessel, of a material which is resistant to sodium, such as, for example, polycrystalline aluminum oxide or yttrium oxide. The outer envelope element, then, may be made of quartz glass or hard glass.

In all the embodiments, the discharge vessel may include a fill of sodium, a noble gas such as xenon, and mercury. If the inner envelope element is made of quartz glass, then the space between the discharge vessel and the inner envelope, preferably, includes a fill of nitrogen, a mixture of nitrogen and a noble gas, or a noble gas alone. If the inner envelope element is made of a material which is resistant to sodium such as, for example, $Al_2O_3$, then the space is preferably filled with sodium and nitrogen, or sodium and a noble gas, or sodium, nitrogen and a noble gas. It has been found that as the temperature increases, which is necessary to increase the sodium vapor pressure, diffusion of sodium from the discharge vessel is prevented if the sodium is introduced in the space within the inner envelope element in such a quantity that, in operation, the sodium vapor pressure within the discharge vessel and outside of the discharge vessel will be in balance. By filling an inert gas with as high pressure as possible, for example nitrogen, or a noble gas, preferably of high atomic weight, vaporization of the material of the discharge vessel within the inner envelope element is reduced.

Within the inner envelope, a convection current will form due to the gas fill. The convection current will be of such level that the hot portions of the discharge vessel are cooled, and the cooler portions thereof are substantially heated. In accordance with a feature of the invention, the temperature at the hottest region of the lamp is lowered, for example by at least 30° C., and the ends of the discharge vessel are heated, for example by at least 100° C. The vapor pressure of the fill within the discharge vessel, a sodium amalgam, is so increased due to the hotter ends of the discharge vessel, that the color rendition index $R_a$ is raised to over 50 from the previously generally available level of 20.

Preferably, the space between the inner and the outer envelope elements is evacuated. A getter may be located therein. The getter, within the space between the two envelope elements, is used to absorb hydrogen and contaminants, and enables maintenance of a high vacuum or, respectively, a low vapor pressure of remaining gases.

DRAWINGS

Figure 4:
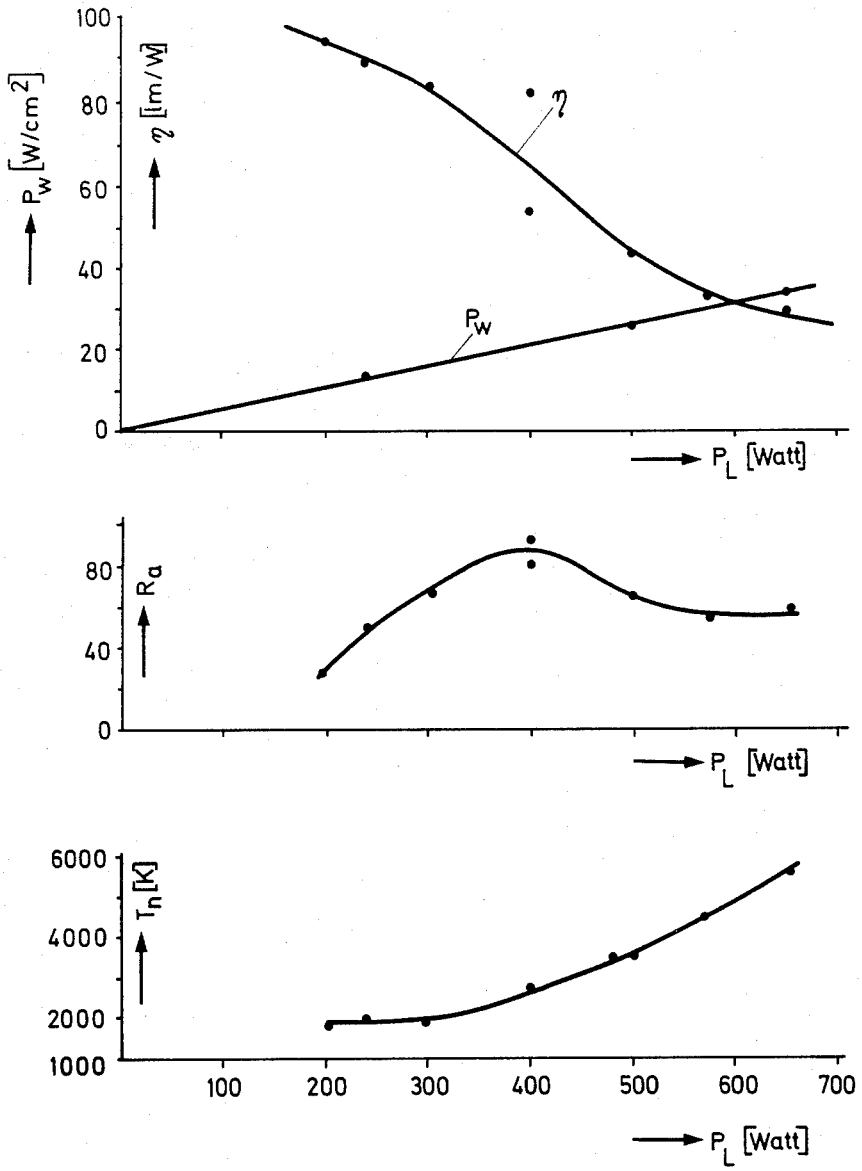
Figure 5:
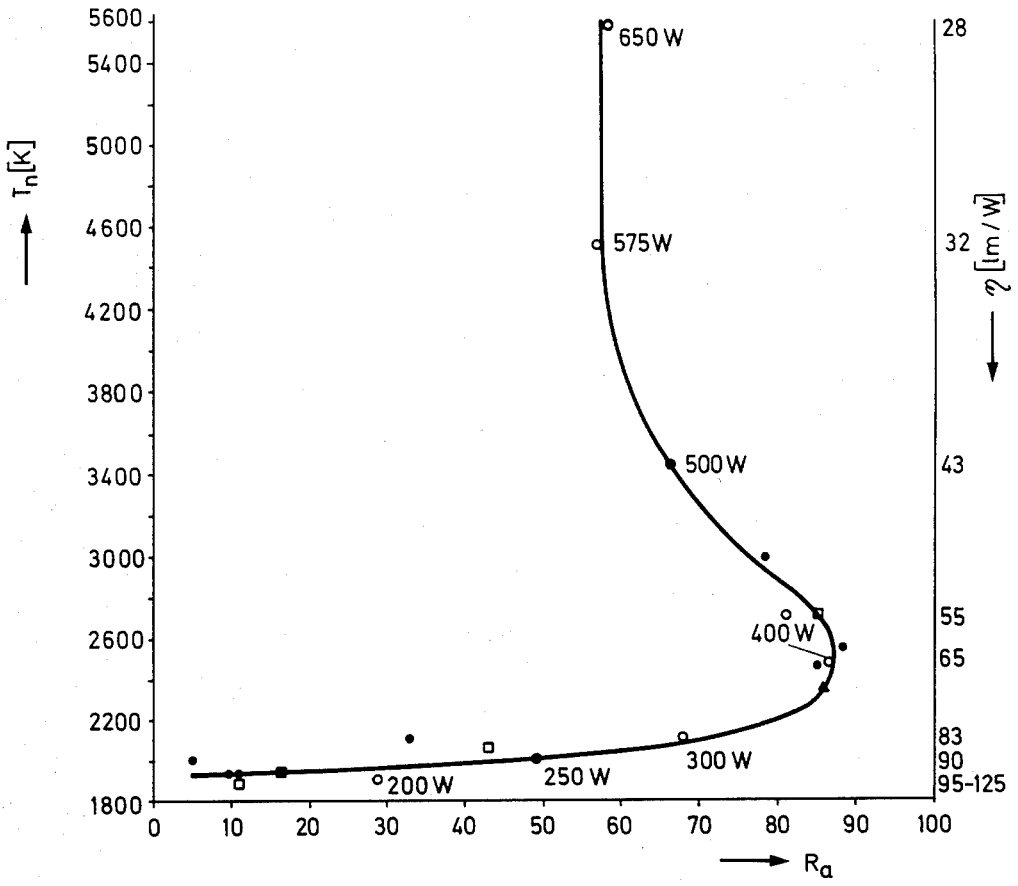

FIG. 4 is a series of graphs for a 250 W sodium high-pressure vapor discharge lamp showing the dependence of light output in lm/W, color rendition index $R_a$, color temperature in ° K., and wall loading in W/cm$^2$ with respect to power rating of the lamp in watts; and FIG. 5 is a graph showing the relationship of color temperature in ° K. and light yield in lm/W with respect to color rendition index $R_a$.

Figure 1:
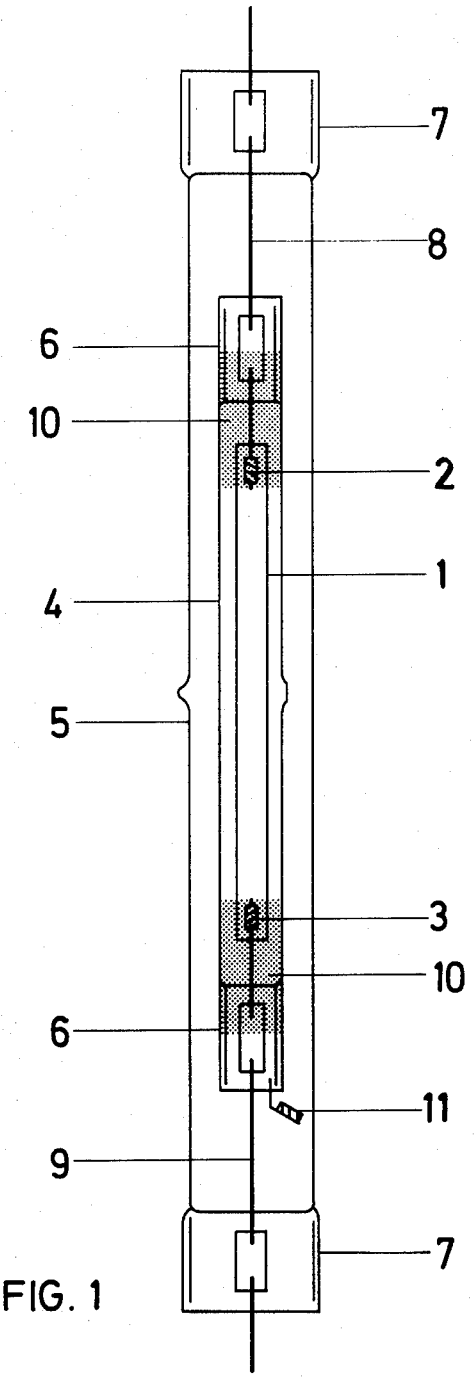
FIG. 1 is a schematic longitudinal view of a tubular double-ended lamp.

The basic structure of the lamp is illustrated in FIG. 1, in which a discharge vessel 1, made of $Al_2O_3$ ceramic, has electrodes 2, 3 introduced therein through its respective ends. The vessel is tubular. An envelope system surrounds the vessel 1. In accordance with the invention, the envelope system has an inner envelope element 4 and an outer envelope element 5.

In accordance with a feature of the invention, the inner envelope 4 is made of quartz glass, and the outer element 5 of quartz glass or hard glass. The two envelope elements 4, 5 which are likewise tubular and the discharge vessel 1 are separate structural elements. The envelope elements 4, 5 are closed off at their ends with a respective press 6, 7, through which the current supply leads 8, 9 are conducted in air-tight manner. The ends of the inner envelope element 4 have a heat reflective coating 10 made of $ZrO_2$.

Data for lamps of this type are reproduced on Table 1.

The sodium amalgam had 21.6%, by weight, sodium.

The space between the discharge vessel 1 and the inner envelope element 4 was filled with nitrogen with a pressure of 960 mbar. The space between the inner envelope element 4 and the outer envelope element 5 was evacuated to at least $10^{-5}$ mbar.

A getter 11 of zirconium or a customary zirconium alloy was located in the space between the two envelope elements.

Figure 2:
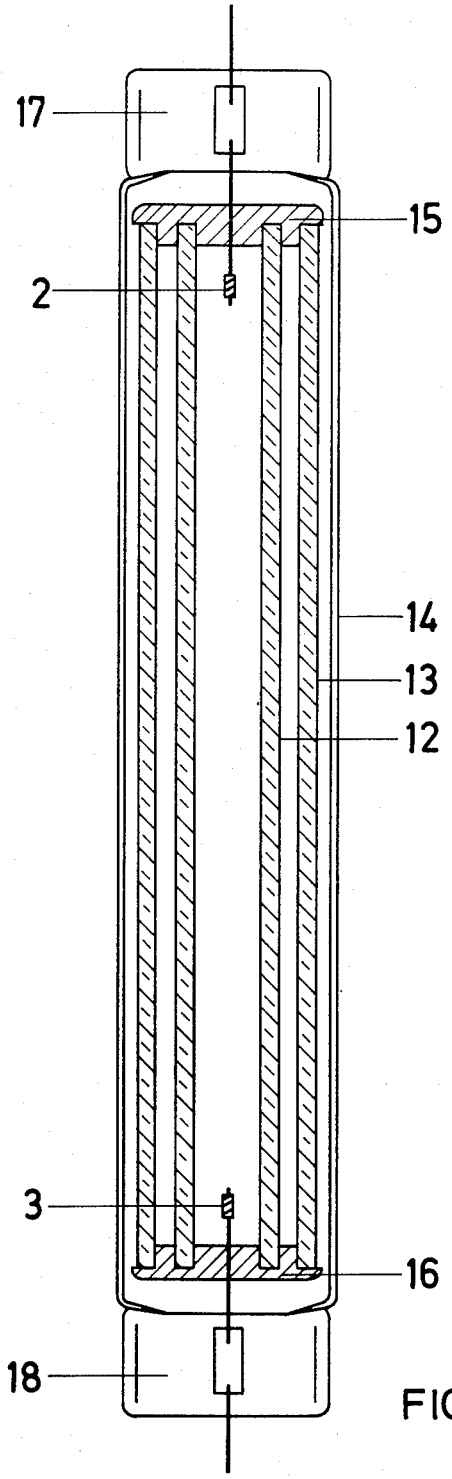
FIG. 2 is an axial cross section of a different embodiment of a double-ended tubular lamp.

Embodiment of FIG. 2: The discharge vessel 12 is made of $Al_2O_3$. The inner envelope 13 is also made of $Al_2O_3$, and the outer envelope 14 made of quartz glass or hard glass. The discharge vessel 12 and the inner envelope element 13 form one structural unit. They are fused at their respective ends with a connecting element 15, 16, respectively, by a melt connection, likewise of $Al_2O_3$. The outer envelope element 14 is closed off at its ends with a press 17, 18, respectively. The electrodes 2, 3 are located in customary manner.

The space between the discharge vessel 12 and the inner envelope element 13 is filled with sodium and nitrogen, in which the sodium of between 5 to 10 mg will not completely vaporize when the lamp is in operation, and the nitrogen is at a pressure of 960 mbar.

Figure 3:
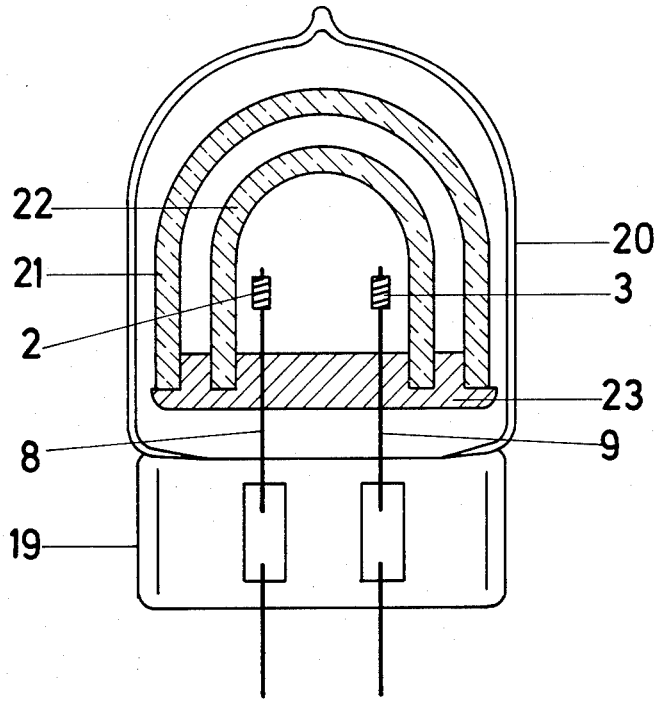
FIG. 3 is a longitudinal cross section of a single-ended lamp.

Embodiment of FIG. 3: A single-ended lamp has two electrodes 2, 3 connected from the same side, and the current leads 8, 9 passed through a press 19 of the outer envelope element 20 made, for example, of quartz glass or hard glass. The inner envelope element 21 is matched in shape to that of the discharge vessel which, generally, is bell-shaped or dome-shaped. The inner envelope element 21 is made of $Al_2O_3$, and surrounds the discharge vessel, likewise made of $Al_2O_3$. The discharge vessel 22 and the inner envelope element 21 form one structural unit. The dome-shaped discharge element 22 is closed off at its end with a terminal element 23 made of $Al_2O_3$ ceramic by being melted or fused thereto; the inner envelope element 21 likewise is fused to the closure element 23. The fill between the discharge vessel 22 and the inner envelope element 21 includes for example 5-10 mg sodium and nitrogen and/or xenon at 960 mbar.

Operation (FIG. 4): The color rendition index $R_a$ above a predetermined temperature, which is determined by the power acceptance of the lamp, decreases, although the color temperature increases. The decrease of the color rendition index $R_a$ upon increasing color temperature $T_n$ is explained by the gap which is caused by inherent absorption of the reversal of the Na-D line upon increasing sodium vapor pressure, which gap eventually becomes so wide that the missing yellow light in the range of about 590 nm causes the overall color rendition index $R_a$ to drop again. Due to the substantial broadening of the short-wave end portion or wing of the reversed Na-D radiation line, the color temperature will increase. The broadened long-wave end portion or wing, however, already reaches in the infrared region and thus does not contribute to lower the color temperature, although it provides, with respect to color temperature, a substantial proportion of saturated red.

FIG. 5 clearly shows that a sodium high-pressure vapor lamp can be obtained which, with 400 W power rating, and a wall loading of 22 W/cm$^2$, will have a color temperature $T_n$ of about 2400° to 2700° K., an overall color rendition index of $R_a \geqq 85$, and a light yield of 60 lm/W. A lifetime of this lamp is obtained which, with a few thousand hours, is not substantially less than known sodium high-pressure vapor discharge lamps.

Various changes and modifications may be made, and features described in connection with any one of the embodiments may be used with any of the others, within the scope of the inventive concept.

TABLE 1

| Power Rating | Electrode Distance | Overall Lamp Length | Diameter of Discharge Vessel 1 |
|---|---|---|---|
| 70 W | 39 mm | 200 mm | 5.5 mm |
| 150 W | 58 mm | 238 mm | 7.0 mm |
| 250 W | 65 mm | 245 mm | 6.0 mm |
| 400 W | 82 mm | 267 mm | 10.0 mm |

| Power Rating | Diameter of Inner Envelope Element 4 | Diameter of Outer Envelope Element 5 | Fill within the Discharge Vessel 1* | |
|---|---|---|---|---|
| | | | Na Hg | Xe |
| 70 | 10 mm | 19 mm | 10 mg | 90 mbar |
| 150 | 13 mm | 22 mm | 25 mg | 80 mbar |
| 250 | 14 mm | 23 mm | 25 mg | 50 mbar |
| 400 | 15 mm | 23 mm | 25 mg | 50 mbar |

*21.6% Na; 78.4% Hg (% by weight)

We claim:

1. Sodium high-pressure discharge lamp having a discharge vessel (1, 12, 22) made of a material resistant to sodium;

discharge electrodes (2, 3) positioned at spaced locations within the discharge vessel;

and an envelope system surrounding the discharge vessel, wherein, in accordance with the invention, the envelope system comprises a first, inner envelope element (4, 13, 21) closely adjacent and surrounding the discharge vessel, and a second, outer envelope element (5, 14, 20) surrounding the first, inner envelope element, and spaced therefrom; and a fill of at least one of the materials of the group consisting of: entirely nitrogen; a mixture of nitrogen and a noble gas; entirely a noble gas; sodium and nitrogen; sodium and a noble gas; sodium, nitrogen, and a noble gas in the space between the discharge vessel and the first, inner envelope element.

2. Lamp according to claim 1, wherein the first and second envelope elements and the discharge vessel are separate structural units.

3. Lamp according to claim 1, wherein the discharge vessel (12, 22) and the first, inner envelope element (13, 21) form a single structural unit.

4. Lamp according to claim 1, wherein (FIGS. 1, 2) the discharge vessel comprises a tube, the electrodes (2, 3) are located at respective opposite end portions of the tube, and the first and second envelope elements surround said discharge vessel with small spacing therefrom, and are closed off at both ends.

5. Lamp according to claim 1, wherein (FIG. 3) the electrodes are located at one side or end portion of the discharge vessel;

and the first and second envelope elements have a shape matched to that of the discharge vessel and surround the discharge vessel with small spacing therefrom, and from each other, respectively.

6. Lamp according to claim 1, wherein the second outer envelope element is made of quartz glass.

7. Lamp according to claim 1, wherein the first envelope element adjacent the discharge vessel is made of a material resistant to sodium.

8. Lamp according to claim 7, wherein the discharge vessel comprises: polycrystalline aluminum oxide; yttrium oxide.

9. Lamp according to claim 1, wherein the outer envelope element comprises hard glass.

10. Lamp according to claim 1, wherein the discharge vessel comprises a fill including sodium, a noble gas, and mercury.

11. Lamp according to claim 1, wherein at least the first inner envelope element (4, 13, 21) comprises quartz glass; and the space between the first envelope element and the discharge vessel comprises a fill of a material selected from the group consisting of: entirely nitrogen; a mixture of nitrogen and a noble gas; entirely a noble gas.

12. Lamp according to claim 1, wherein the first inner envelope element (4, 13, 21) comprises a material resistant to sodium;

and wherein the space between the first, inner envelope element and the discharge vessel comprises a fill of at least one of the materials of the group consisting of: sodium and nitrogen; sodium and a noble gas; sodium, nitrogen, and a noble gas.

13. Lamp according to claim 12 wherein the discharge vessel comprises polycrystalline aluminum oxide; yttrium oxide.

14. Lamp according to claim 1, wherein the space between the first, inner envelope element and the second, outer envelope element is sealed and evacuated.

15. Lamp according to claim 14, further including a getter (11) positioned in the space between the first, inner and the second, outer envelope elements.

16. Lamp according to claim 1, further including an infrared reflective layer on the second outer envelope element (5, 14, 20).

17. Lamp according to claim 1, wherein at least the inner envelope element (4, 13, 21) comprises quartz glass;

and a heat reflective layer (10) applied to the outside of the inner envelope element in the region of the electrodes.

18. Lamp according to claim 17, wherein the heat reflective layer comprises $ZrO_2$.

19. Lamp according to claim 1, including an infrared reflective layer positioned over at least a part of the surface of the first, inner envelope element (4, 13, 21).

* * * * *

UNITED STATES PATENT AND TRADEMARK OFFICE

CERTIFICATE OF CORRECTION

PATENT NO. : 4,490,642

DATED : December 25, 1984

INVENTOR(S) : Alexander DOBRUSSKIN

It is certified that error appears in the above-identified patent and that said Letters Patent is hereby corrected as shown below:

The following claims should read--

8. Lamp according to claim 7 wherein the first, inner envelope element comprises: polycrystalline aluminum oxide; yttrium oxide.

9. Lamp according to claim 1 wherein the second outer envelope element comprises hard glass.

13. Lamp according to claim 12 wherein the first, inner envelope element comprises: polycrystalline aluminum oxide; yttrium oxide --.

Signed and Sealed this

*Twenty-seventh* Day of *August 1985*

[SEAL]

*Attest:*

DONALD J. QUIGG

*Attesting Officer* *Acting Commissioner of Patents and Trademarks*